US009113660B2

(12) United States Patent
Op't Hof

(10) Patent No.: US 9,113,660 B2
(45) Date of Patent: Aug. 25, 2015

(54) NURSING UNDERGARMENT THAT ATTACHES TO A TOP-OPENING NURSING BRASSIERE

(75) Inventor: Elisa Sheranian Op't Hof, Spanish Fork, UT (US)

(73) Assignee: Undercover Mama, LLC, Spanish Fork, UT (US)

( * ) Notice: Subject to any disclaimer, the term of this patent is extended or adjusted under 35 U.S.C. 154(b) by 394 days.

(21) Appl. No.: 13/021,733

(22) Filed: Feb. 5, 2011

(65) Prior Publication Data

US 2011/0124267 A1 May 26, 2011

Related U.S. Application Data

(63) Continuation-in-part of application No. 12/537,249, filed on Aug. 6, 2009, now abandoned.

(51) Int. Cl.

| | |
|---|---|
| ***A41D 1/20*** | (2006.01) |
| ***A41C 3/04*** | (2006.01) |
| ***A41B 9/06*** | (2006.01) |
| ***A41C 3/08*** | (2006.01) |

(52) U.S. Cl.

CPC ... *A41B 9/06* (2013.01); *A41C 3/08* (2013.01); *A41D 1/205* (2013.01)

(58) Field of Classification Search

USPC ..... 2/48, 49.1, 49.2, 49.3, 49.5, 50, 51, 52, 2/80, 75, 111, 101, 103, 104, 113, 114, 2/118, 119, 120; 450/3, 4, 6, 7, 10, 11, 450/12, 14, 18, 26, 28, 30, 31, 32, 33, 36

See application file for complete search history.

(56) References Cited

U.S. PATENT DOCUMENTS

| | | | | | |
|---|---|---|---|---|---|
| 1,632,137 | A | | 6/1927 | Jackson | |
| 1,927,018 | A | * | 9/1933 | Bloom | 450/32 |
| 2,009,620 | A | * | 7/1935 | Jackson | 450/28 |
| 2,113,795 | A | * | 4/1938 | Marshall | 2/73 |
| 2,359,804 | A | * | 10/1944 | Struthers | 450/32 |
| 2,482,994 | A | * | 9/1949 | Wiley | 450/32 |
| 2,493,179 | A | * | 1/1950 | Wittenberg | 450/32 |
| 2,501,860 | A | * | 3/1950 | Becker | 450/36 |
| 2,595,139 | A | | 4/1952 | Hart | |
| 2,599,302 | A | * | 6/1952 | Von Thaden | 450/14 |
| 2,613,355 | A | * | 10/1952 | Coleman | 450/36 |
| 2,654,091 | A | * | 10/1953 | Nelson | 450/14 |
| 2,679,048 | A | * | 5/1954 | Alberts | 450/36 |
| 2,925,816 | A | * | 2/1960 | Rosenthal | 450/37 |
| 3,212,503 | A | * | 10/1965 | Gorman | 450/32 |
| 3,611,439 | A | * | 10/1971 | Meyers | 2/54 |
| 4,024,876 | A | * | 5/1977 | Penrock | 450/48 |

(Continued)

*Primary Examiner* — Alissa L Hoey

(74) *Attorney, Agent, or Firm* — Polsinelli PC; Adam C. Rehm

(57) ABSTRACT

A strapless camisole undergarment has a front upper portion which is detachably affixable to each of the fold-down cup cover flaps of a standard, top-opening nursing bra. Attachment is made just below the clasp on each fold-down cover flap. Intended to be worn beneath any front-opening or pull-over blouse or shirt, the undergarment enables a woman to discreetly breastfeed an infant maintaining her lower torso covered while her outer shirt is lifted or open. Thus, a woman desiring to nurse her child need only open or raise the outer shirt, unhook a cup cover flap, and lower both the flap and the attached undergarment in order to access a breast. When the child has finishing nursing on that breast, the woman raises the flap and reattaches it—along with the attached undergarment—to the hook at the top of the bra cup.

17 Claims, 7 Drawing Sheets

(56) References Cited

U.S. PATENT DOCUMENTS

| | | | | |
|---|---|---|---|---|
| 4,372,320 | A * | 2/1983 | Silber | 450/31 |
| 4,398,538 | A * | 8/1983 | Johnson | 450/8 |
| 4,648,404 | A * | 3/1987 | Clark | 450/31 |
| 4,798,557 | A | 1/1989 | Scott | |
| 4,811,429 | A * | 3/1989 | Perez | 2/83 |
| 4,878,879 | A * | 11/1989 | Kunstadter | 450/36 |
| 4,911,677 | A * | 3/1990 | White | 450/36 |
| 5,624,296 | A * | 4/1997 | Weber-Unger | 450/36 |
| 5,640,715 | A * | 6/1997 | Adams | 2/46 |
| 5,911,311 | A * | 6/1999 | Hutchins | 2/49.5 |
| 5,980,359 | A * | 11/1999 | Brown | 450/57 |
| 6,032,287 | A * | 3/2000 | Kallas | 2/69 |
| 6,186,863 | B1 * | 2/2001 | Kim | 450/86 |
| 6,216,269 | B1 * | 4/2001 | Smith et al. | 2/46 |
| 6,266,822 | B1 * | 7/2001 | Joyce | 2/83 |
| 6,282,719 | B1 * | 9/2001 | Vera et al. | 2/78.1 |
| 6,319,092 | B1 * | 11/2001 | Leyhe et al. | 450/36 |
| 6,346,027 | B1 * | 2/2002 | Merkovsky | 450/37 |
| 6,645,041 | B2 * | 11/2003 | Sorensen | 450/36 |
| 6,811,462 | B1 * | 11/2004 | Kenneally | 450/30 |
| 6,839,908 | B2 * | 1/2005 | Schneider et al. | 2/73 |
| 6,846,217 | B1 * | 1/2005 | Struble et al. | 450/31 |
| 6,854,132 | B1 * | 2/2005 | Polzin | 2/104 |
| 6,855,029 | B2 * | 2/2005 | Rothman | 450/36 |
| 7,076,809 | B2 * | 7/2006 | Rothman | 2/104 |
| 7,077,720 | B2 * | 7/2006 | Schneider et al. | 450/36 |
| 7,081,034 | B1 * | 7/2006 | Zoellner | 450/54 |
| 7,174,570 | B2 * | 2/2007 | Dabney et al. | 2/48 |
| 7,201,629 | B2 * | 4/2007 | Lambru | 450/1 |
| 7,232,359 | B1 * | 6/2007 | Richardson | 450/86 |
| 7,395,556 | B2 * | 7/2008 | Eraca | 2/104 |
| 7,409,728 | B2 * | 8/2008 | Harry | 2/106 |
| 7,448,090 | B2 * | 11/2008 | Lucock | 2/104 |
| 7,488,234 | B2 * | 2/2009 | Rothman et al. | 450/36 |
| 7,520,794 | B1 * | 4/2009 | Johnson | 450/1 |
| D595,932 | S * | 7/2009 | Deal | D2/706 |
| 7,665,151 | B1 * | 2/2010 | Finell | 2/49.1 |
| 7,780,502 | B2 * | 8/2010 | Calamari et al. | 450/86 |
| 7,878,880 | B2 * | 2/2011 | Hendrickson | 450/36 |
| 7,878,881 | B2 * | 2/2011 | Hendrickson | 450/36 |
| 7,946,904 | B1 * | 5/2011 | Ciullo | 450/7 |
| 8,062,093 | B2 * | 11/2011 | DeSousa | 450/30 |
| 8,100,737 | B2 * | 1/2012 | Deal | 450/30 |
| 8,196,223 | B2 * | 6/2012 | Hamilton et al. | 2/114 |
| 8,221,186 | B2 * | 7/2012 | Policaro et al. | 450/1 |
| 8,226,452 | B2 * | 7/2012 | Hendrickson | 450/30 |
| 8,241,088 | B2 * | 8/2012 | Murphy et al. | 450/30 |
| 8,307,463 | B2 * | 11/2012 | Ritchie | 2/104 |
| 8,371,901 | B2 * | 2/2013 | Frey | 450/30 |
| 2004/0137821 | A1 * | 7/2004 | Sandroussi et al. | 450/34 |
| 2005/0026540 | A1 * | 2/2005 | Schneider et al. | 450/36 |
| 2005/0028243 | A1 * | 2/2005 | Polzin | 2/104 |
| 2005/0085160 | A1 * | 4/2005 | Johnstone | 450/36 |
| 2005/0235394 | A1 * | 10/2005 | Pew | 2/111 |
| 2006/0010558 | A1 * | 1/2006 | Prater | 2/111 |
| 2006/0026728 | A1 * | 2/2006 | Shaw | 2/49.1 |
| 2007/0074330 | A1 * | 4/2007 | Azaronak | 2/104 |
| 2007/0105481 | A1 * | 5/2007 | Scholz | 450/3 |
| 2007/0271675 | A1 * | 11/2007 | Eraca | 2/104 |
| 2008/0000004 | A1 * | 1/2008 | Lucock | 2/104 |
| 2008/0022434 | A1 * | 1/2008 | Adelman | 2/104 |
| 2008/0064299 | A1 * | 3/2008 | La Fontaine | 450/36 |
| 2008/0078208 | A1 * | 4/2008 | Kronbach | 66/171 |
| 2008/0250541 | A1 * | 10/2008 | Chen | 2/49.1 |
| 2009/0036022 | A1 * | 2/2009 | Tolliver | 450/36 |
| 2009/0217439 | A1 * | 9/2009 | Ross | 2/73 |
| 2009/0265830 | A1 * | 10/2009 | Hendrickson | 2/104 |
| 2009/0265831 | A1 * | 10/2009 | Hendrickson | 2/104 |
| 2010/0017936 | A1 * | 1/2010 | Deal | 2/113 |
| 2010/0031418 | A1 * | 2/2010 | Op't Hof | 2/113 |
| 2010/0058512 | A1 * | 3/2010 | Rothman | 2/104 |
| 2010/0068971 | A1 * | 3/2010 | Hendrickson | 450/31 |
| 2010/0107302 | A1 * | 5/2010 | Ross | 2/113 |
| 2010/0203803 | A1 * | 8/2010 | Murphy et al. | 450/28 |
| 2011/0201251 | A1 * | 8/2011 | De Sousa et al. | 450/28 |
| 2012/0144552 | A1 * | 6/2012 | Ross | 2/113 |
| 2012/0220191 | A1 * | 8/2012 | Murphy et al. | 450/28 |

* cited by examiner

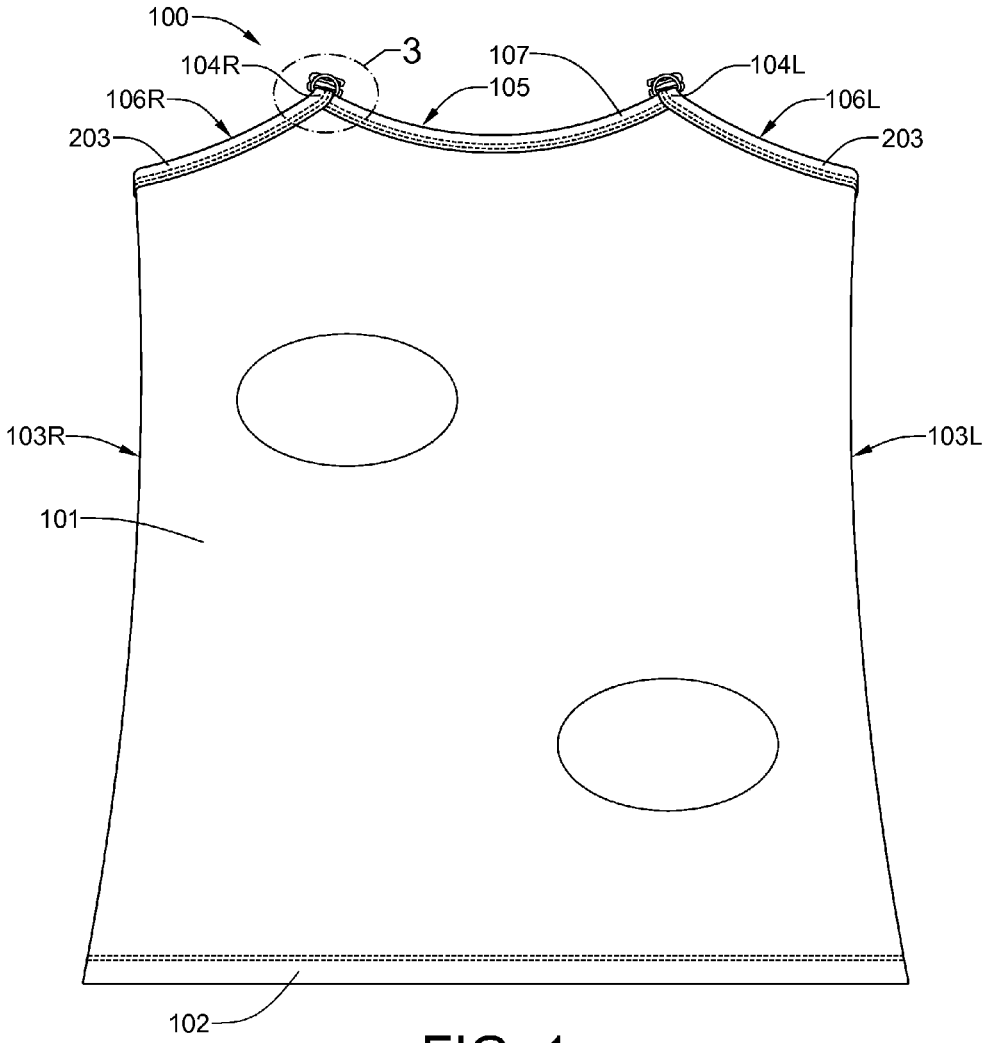
FIG. 1
FIG. 3
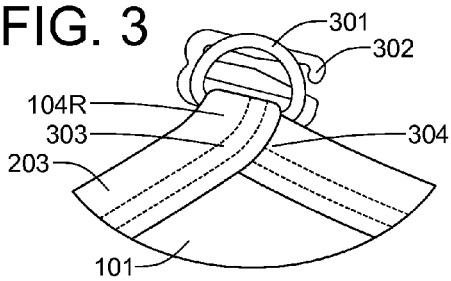
FIG. 4
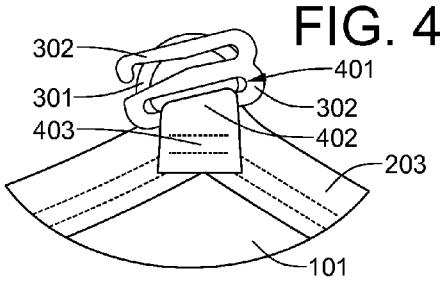

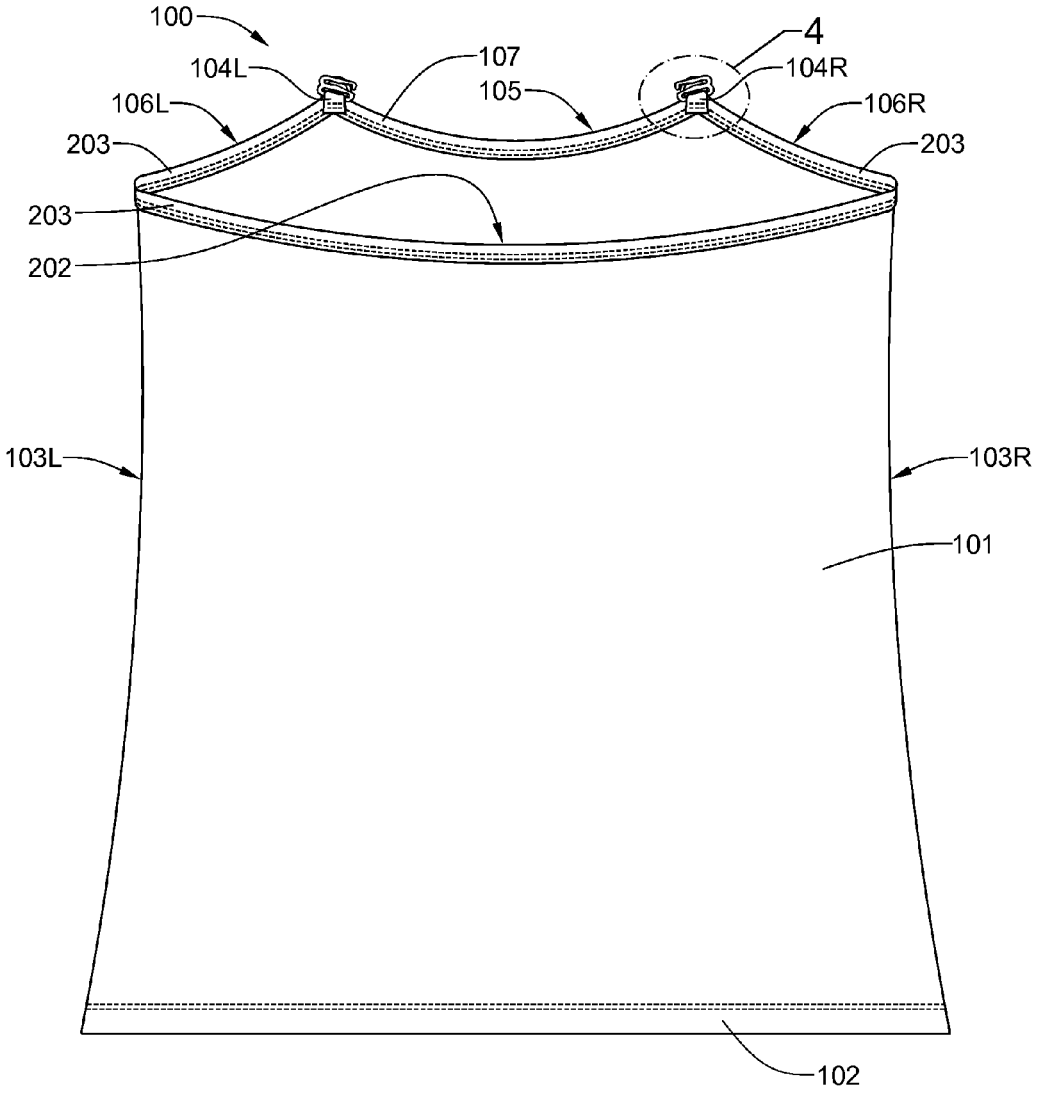
FIG. 2
FIG. 5
(PRIOR ART)
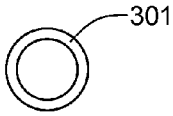
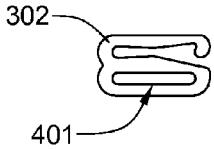
FIG. 6
(PRIOR ART)

NURSING UNDERGARMENT THAT ATTACHES TO A TOP-OPENING NURSING BRASSIERE

This is a Continuation-in-Part of U.S. patent application Ser. No. 12/537,249, which was filed on Aug. 6, 2009 now abandoned by the same named inventor.

BACKGROUND OF THE INVENTION

1. Field of the Invention

This invention relates to nursing undergarments and, more specifically, to an undergarment which directly attaches to the fold-down cup cover flaps of any standard top-opening, nursing brassiere (hereinafter, also "bra").

2. Description of the Prior Art

Conventional nursing apparel suffers from a number of drawbacks. Most nursing shirts typically require a woman to go through multiple layers, slits or flaps in order to gain access to her breasts. This can be somewhat cumbersome. A typical article of clothing for nursing is a camisole, tank top or undershirt permanently attached to a nursing bra with fold-down cups. A drawback to such a combination clothing item is that each tank top or undershirt is inseparably sewn to the nursing bra. Because the number of clothing items, which combine both an undershirt and a bra, is much more limited than the number of both undershirts and bras available separately, the use of combination clothing items for a nursing woman severely limits her choice of color, style, fit and design of not only the undershirts, but also of the incorporated nursing bras, as well. In addition, because of the rather specialized nature of such combination garments, they are typically more expensive than the combined cost of individual items of comparable quality (i.e., the cost of an undershirt plus the cost of a nursing bra). Thus, a woman who desires to nurse her child and, at the same time, have a varied wardrobe, must—at considerable cost—purchase a number of these combination clothing items. The cost problem is exacerbated by a further complication: The built-in nursing bras in off-the-shelf combination nursing garments Women may not suit a particular woman. The bra may not have certain features important to the woman, such as adequate support, underwire construction, or a particular color, level of padding, shape, desired fabric, level of adornment, or style. The selection of a bra, whether it be one having fold-down cups for nursing, or one without such a feature, is a very personal decision. The current state of the art in nursing apparel severely limits a woman's choice in the selection of both undershirts and brassieres.

SUMMARY OF THE INVENTION

The present invention eliminates the problems associated with the prior art nursing brassieres and attached undergarments. The invention provides a specialized nursing undergarment—in the form of a camisole, tank top or under shirt—an upper portion of which is detachably affixable to the top of the fold-down cup cover flaps of any standard top-opening nursing bra. The specialized undergarment is intended to be worn beneath any front-opening or pull-over blouse or shirt that is not designed specifically for nursing mothers. Because the invention attaches to the cup cover flaps of a nursing bra, the mother does not have to open and close additional layers in order to gain access to her breasts. When a woman utilizing the invention desires to nurse her infant, she need only open or raise the outer shirt, and, then, unhook and lower one of the cup cover flaps on the nursing bra to access a breast. When the infant has finishing nursing on that breast, the woman raises the fold-down cup cover flap and reattaches it—along with the attached undergarment—to the hook at the top of the bra cup. The invention enables a woman to discreetly breast feed an infant, as the undergarment attached to the nursing bra enables her to maintain her lower torso covered while her outer shirt is lifted or opened for the feeding. The invention works with practically any standard nursing bra available in the marketplace.

This invention simplifies breastfeeding procedures because the undergarment of the present invention is attached directly to the cup cover flaps of a nursing bra and need not need to be detached from the bra in order to nurse. Thus, a woman would simply lower the fold-down cup cover flap of a nursing bra, with the attached undergarment releasing with the cup cover flap, as if the nursing bra and undergarment were a combined clothing article. It remains attached to the cover flap of the bra cup as long as the woman desired to wear that combination of undergarment and nursing bra.

The undergarment of the present invention is advantageous because a woman may choose any combination of outer blouse or shirt and nursing brassiere. In addition, the woman may choose from any nursing bra available in the marketplace for use in combination with the specialized nursing undergarment of the present invention. She is no longer limited to purchasing one of much fewer nursing bras which have a nursing undergarment permanently attached.

While primarily intended for use by nursing mothers, this invention can also be used by non-nursing women. The undergarment of the present invention can also be attached to the uppermost portion of the cups or to the straps of any standard, non-nursing, brassiere. When used in this manner, the undergarment functions as a layering undershirt worn beneath a blouse or outer shirt. A front-opening blouse can even be left unbuttoned or open, thereby presenting the same general appearance as a regular camisole under the shirt.

BRIEF DESCRIPTION OF THE DRAWINGS

FIG. 1 is a front elevational view of an undergarment manufactured in accordance with the present invention;

FIG. 2 is a rear elevational view of the undergarment of FIG. 1;

FIG. 3 is an enlarged view of oval region 3 of FIG. 1;

FIG. 4 is an enlarged view of oval region 4 of FIG. 2;

FIG. 5 is an enlarged top plan view of a silicone rubber O-ring used as a first of two alternative strap attachment devices in the embodiment of FIGS. 1 and 2;

FIG. 6 is an enlarged top plan view of a strap attachment clip used as a second of two alternative strap attachment devices in the embodiment of FIGS. 1 and 2;

DETAILED DESCRIPTION OF THE INVENTION

Figure 7:
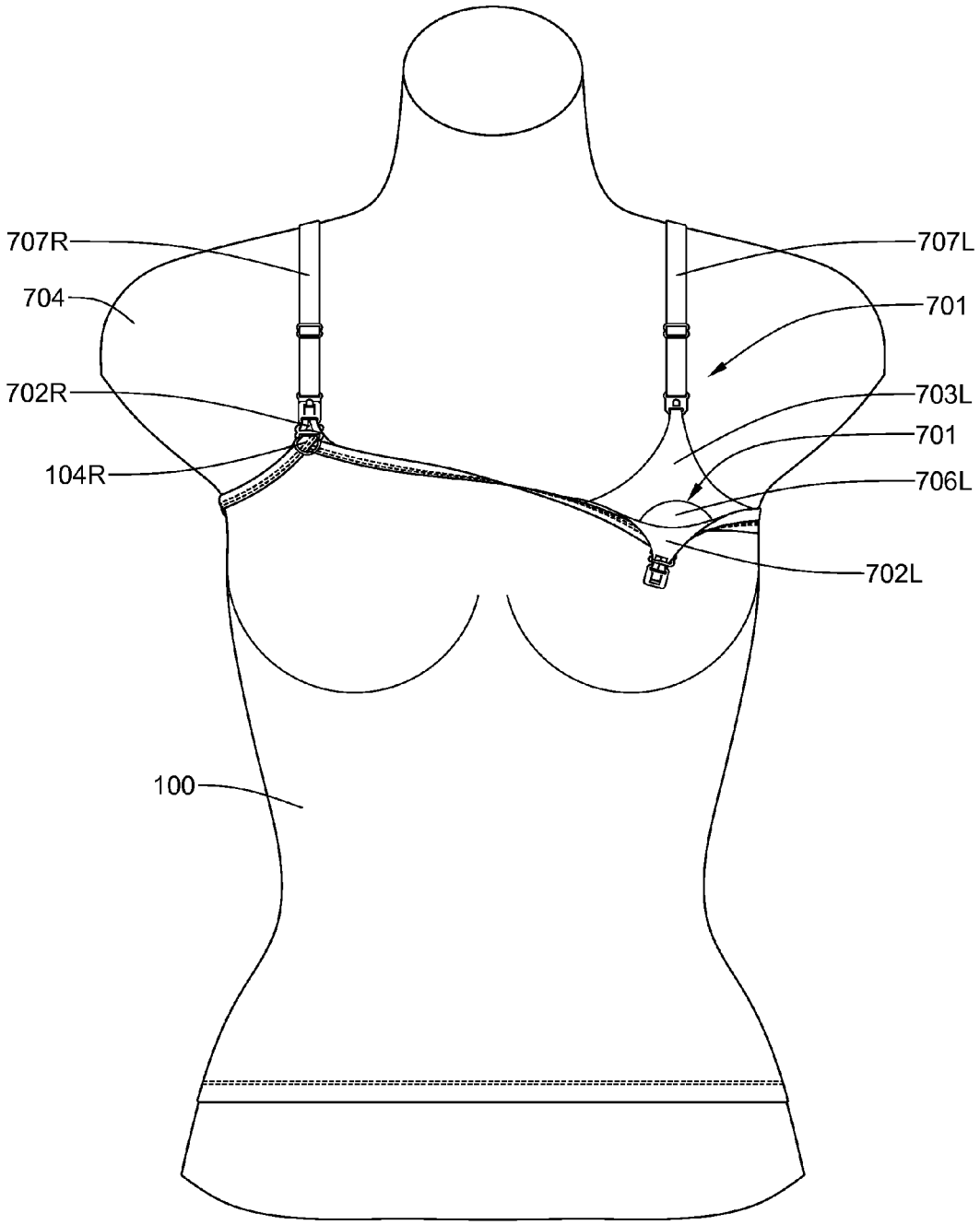
FIG. 7 is a front elevational view of a female mannequin torso and neck that is wearing a convention nursing brassiere, with fold-down cup flaps, beneath the undergarment shown in FIGS. 1 and 2, an upper front edge of which is releasably secured to an uppermost portion of each cup flap.

The invention will now be described in detail, with reference to drawing FIGS. 1 to 4. It should be understood that the drawings are meant to be merely illustrative of the invention, and may not be drawn to precise scale. The invention includes both an undergarment product and a method of making the undergarment product. Although a presently preferred embodiment of the undergarment product looks much like a strapless camisole, it will be obvious to those having ordinary skill in the art that other types of sleeveless undergarments, such as tank tops, can either be manufactured as a new item in accordance with the present invention, or an already-made undergarment can be modified to achieve the same function.

Referring now to FIGS. 1 and 2, a presently preferred embodiment nursing undergarment 100 has the appearance of a strapless, sleeveless, bare-shoulder camisole. A presently preferred embodiment of the undergarment 100 has a garment body that is sewn together from two pieces of fitted, warp-knit fabric that is a blend of a 95% cotton fibers and 5% spandex fibers; a front panel 101 and a rear panel 201, which are sewn together in vertical side seams below the arm pits of the wearer. The undergarment 100 has a bottom seam 102 and preferably sufficient length to at least completely cover the wearer's midriff. Though a cotton/spandex blend is the presently preferred fabric for the undergarment 100, a combination of spandex fibers with other fibers is also contemplated. For example, the cotton component may be replaced with modal, linen, flax (i.e., linen), jute, hemp, wool, silk, polyester, nylon or acrylic fibers. In addition, spandex fibers may be combined with two or more of the other listed fibers.

Because of the importance of using stretchable knit fabric in the manufacture of the present invention, and because spandex—a manmade organic compound—is a primary component of most stretchable fabrics, a brief description of the material is deemed appropriate. Spandex (an anagram of the word "expands"), or elastane, as it is more commonly known in Europe, is a synthetic copolymer that is made into fibers known for their exceptional elasticity. Chemically, spandex is made up of a long-chain polyglycol combined with a short diisocyanate, and contains at least 85% polyurethane. It is an elastomer, which means it can be stretched up to a certain amount without sustaining any appreciable molecular damage. When released, it recoils to its original dimensions. These fibers are superior to rubber because they are stronger, lighter, and more versatile. In fact, spandex fibers can be stretched to almost 500% of their length. First formulated by chemist Joseph Shivers at DuPont's Benger Laboratory in Waynesboro, Virginia in the early 1950s, it revolutionized many areas of the clothing industry after it was first incorporated into fabrics in 1959. For clothing, spandex is usually mixed with cotton or polyester, and may account for as little as two percent of the final fabric by weight. Clothing incorporating small amounts of spandex therefore retains most of the look and feel of the more prevalent fibers. In North America it is rare in men's clothing, but prevalent in women's.

Still referring to FIGS. 1 and 2, when laid out on a flat surface, the vertical side seams 103R and 103L, which join the front panel 101 to the rear panel 201, are on the outer vertical edges of the undergarment 100. The front panel 101 is shaped like that of a conventional camisole, having a bilaterally-symmetrical wave pattern upper edge consisting of two spaced-apart peaks 104R and 104L, a central trough 105 joining the peaks 104R and 104L, and arcuate half-troughs 106R and 106L on the outer sides of the peaks 104R and 104L, respectively, which transition to the rear upper edge 202 of the undergarment 100. A major difference between the undergarment 100 of the present invention and a conventional camisole is an absence of a strap which would otherwise interconnect each peak 104R and 104L to the rear upper edge 202 of the undergarment 100.

Still referring to drawing FIGS. 1 and 2, the entire front upper edge (including components 104R, 104L, 105, 106R and 106L) and the entire rear upper edge 202 are hemmed by wrapping them with bias binding ribbon made of the same cotton-spandex blend as the front and rear panels 101 and 201. A front bias binding ribbon 107 is used to hem the edge of the central trough 105, while a much longer rear bias binding ribbon 203 is used to hem not only the rear upper edge 202, but also the edges of the arcuate half-troughs 106R and 106L, as well. As the rear bias binding ribbon 203 is sewn to both the rear upper edge 202 and the arcuate half-troughs 106R and 106L, it reinforces the top of each vertical side seam 103R and 103L. Though the undergarment 100 shown and described in FIGS. 1 and 2 has a scooped neckline, the basic design is adaptable to many other neckline styles, such as horizontal, V-neck, and buttoned faux vertical slit.

Referring now to FIGS. 3 and 4, which are enlarged views of region 3 of FIG. 1 and region 4 of FIG. 2, respectively, it will be noted that each peak 104R and 104L on the upper edge of the front panel 101 is equipped with a plurality, i.e. two, fold-down cup cover flap attachment devices: a silicone rubber O-ring 301 and a strap attachment clip 302. The strap attachment clips 302, which must be fairly rigid, are preferably stamped from sheet metal, such as brass, stainless steel, or aluminum (which is then can be heat treated for durability and anodized for corrosion resistance). The clips are preferably coated with a polymeric plastic compound, such as nylon or polyvinylchloride. The color of the coating can be selected to match the fabric color of the undergarment 100. The plurality of attachment devices (i.e., O-ring 301 and the strap attachment clip 302) are attached to their associated peak 104R or 104L with a small loop formed by an end of the rear bias binding ribbon 203. That is to say, each of the opposite ends of the rear bias binding ribbon 203 passes through a silicon rubber O-ring 301 and through an attachment slot 401 in the strap attachment clip 302, is folded behind the front panel 101 (i.e., to the inside surface of the undergarment 100), thereby forming a loop 402 of generally minimum diameter. The rear bias binding ribbon 203 is trimmed to leave a short tail 403, which is sewn to a front portion 303 of the rear bias binding ribbon 203, to an end portion 304 of the front bias binding ribbon 107, and also to the stretch fabric of the front panel 101, on the inside of the undergarment 100. Although the strap attachment clip 302 works fine for standard thickness fold-down cup cover flaps, the O-ring 301 is more easily able to accommodate fold-down cup cover flaps which somewhat thicker (i,e., more heavily padded).

Referring now to FIG. 5, the O-ring 301 is shown unconnected to the under garment 101. When not subjected to distorting forces, the O-ring 301 has a toroidal shape.

Referring now to FIG. 6, a strap attachment clip 302 is shown unconnected to the undergarment 100. As previously stated, the strap attachment clips 302 should be fairly rigid, and preferably stamped from a stiff sheet metal. Though brass, heat-treated anodized aluminum and brass can be used successfully in this application, stainless steel is considered the preferred metal. The strap attachment clips 301 are preferably also coated with a polymeric plastic compound, such as nylon or polyvinylchloride. The color of the coating can be selected to match the fabric color of the undergarment 100.

Figure 8:
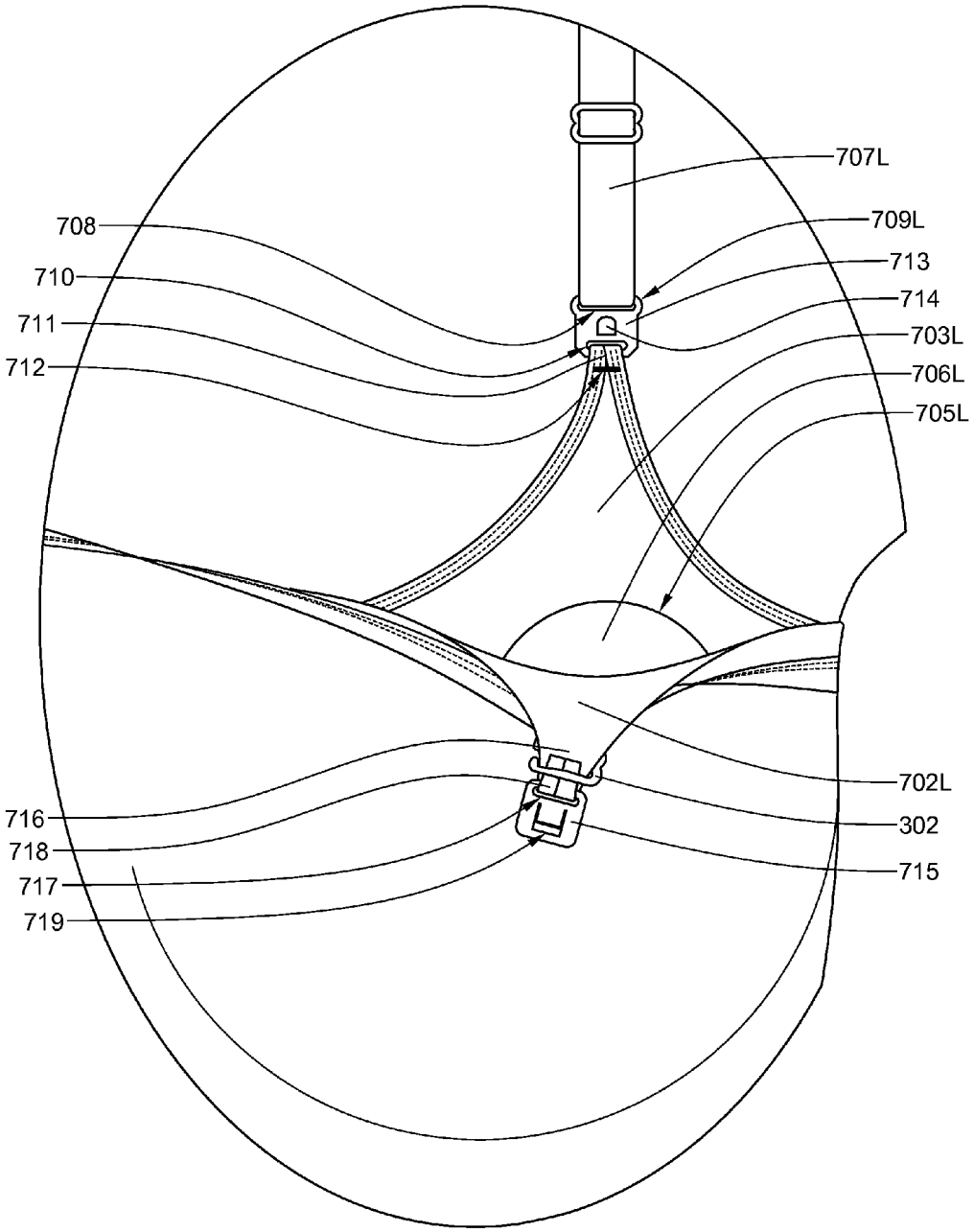
FIG. 8 is an enlarged view of circular region 8 of FIG. 7.

Referring now to both FIG. 7 and FIG. 8, which is an enlarged view of region 8 of FIG. 7, a conventional nursing brassiere 701, having fold-down cup flaps 702R and 702L, and partially open cups 703R and 703L, has been strapped to a female mannequin torso 704. The undergarment 100 has been pulled over the mannequin torso 704 so as to cover the nursing brassiere 701 and a lower portion of the torso 704. The right peak 104R of the front upper edge of the undergarment 100 has been secured to an uppermost portion of the right cup flap 702R and the left peak 104L of the front upper edge of the undergarment 100 has been secured to an uppermost portion of the left cup flap 702L with a strap attachment clips 302. The left cup flap 702L has been unsnapped from the left cup 703L and partially folded down. Each bra cup 703R and 703L has a central aperture 705R (not shown) and 705L, respectively, that exposes the nipple and areola of the respective breast. The fold-down cup cover flaps 702R and 702L can be positioned so as to either cover or expose central apertures 705R and 705L, respectively. In the view of FIG. 7, the right fold-down cup cover 702R is covering right central aperture 705R, while the left fold-down cup 702L, in its folded-down position, has exposed the left central aperture 705L and an upper portion of the female mannequin's left breast 706L. The right and left over-the shoulder straps 707R and 707L, respectively, of the nursing brassiere 701 are permanently and adjustably secured to a top aperture 708 of a plastic link 709R or 709L. A bottom aperture 710 of each plastic link 709R or 709L is permanently secured to an uppermost portion of its associated bra cup 703R or 703L, which is folded rearward to make a loop 711 of minimum diameter, and then secured with stitches 712 to the rear of the bra cup 703R or 703L near the very top thereof. The central body 713 of each plastic link 709R or 709L incorporates an upwardly angled hook 714, to which an eye member 715, that is secured to the uppermost portion of each cup cover flap 702R and 702L, releasably attaches. The apex 716 of each cup cover flap 702R and 702L passes through an aperture 717 in the eye member 715 and is folded down to form a loop 718, also of minimum diameter, with the apex 716 being sewn to the back of its respective cup cover flap 702R and 702L near the very top thereof. Each eye member 715 has a rectangular eye 719, which snaps over the upwardly angled hook 714 of its respective plastic link 709R or 709L.

Figure 9:
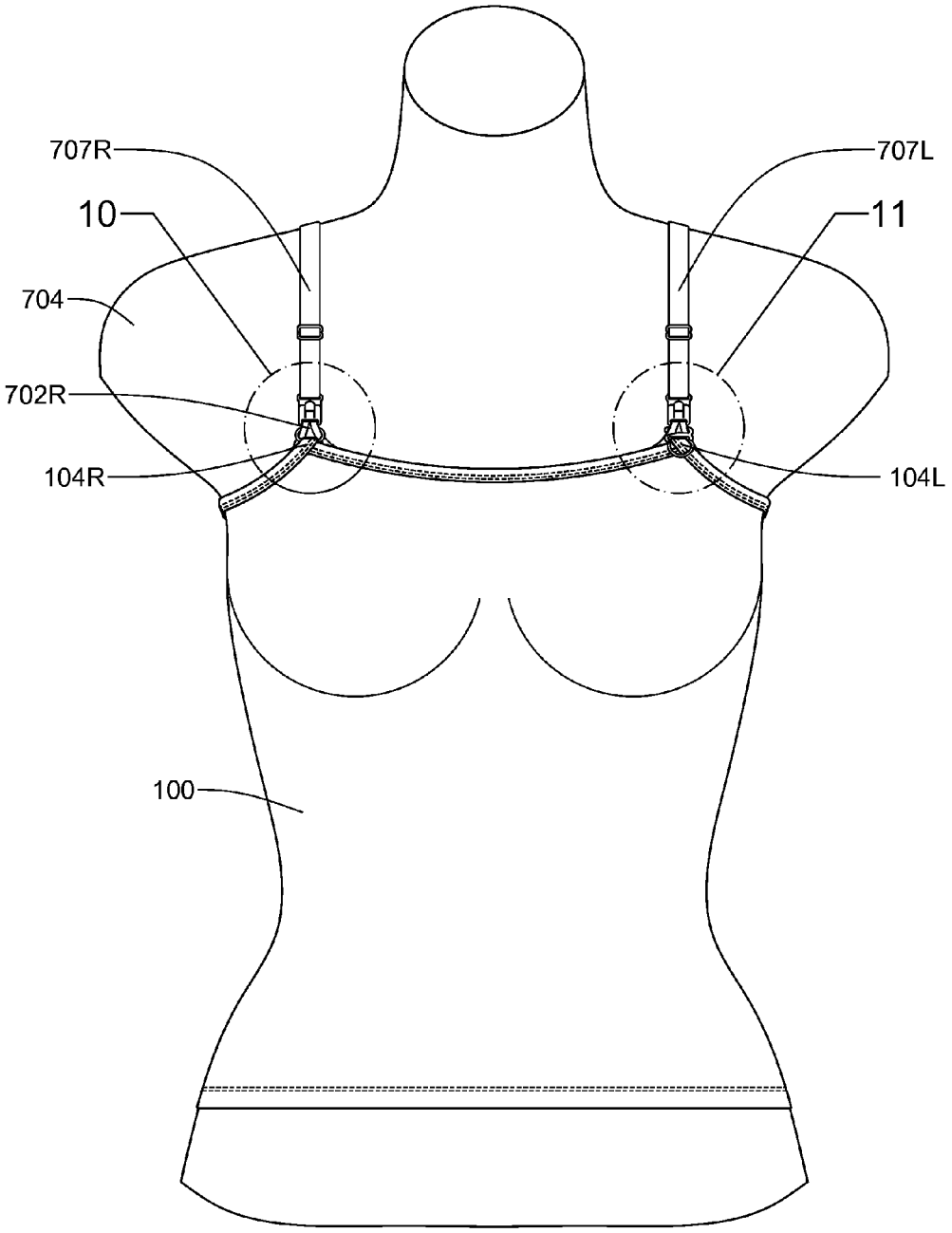
FIG. 9 is an enlarged view of circular region 9 of FIG. 7.

Referring now to FIG. 9, the undergarment 100 is shown covering the same conventional nursing brassiere 701 on the same female mannequin torso 704 as in FIG. 7. The differences are that the left fold-down cup flap 702L has been raised to its fully-closed position, with the eye member 715 snapped to the upwardly angled hook 714 of plastic link 709L, and the right peak 104R of the front upper edge of the undergarment 100 has been secured to an uppermost portion of the right cup flap 702R with the O-ring 301, rather than with the strap attachment clip 302, as in FIG. 7.

Figure 10:
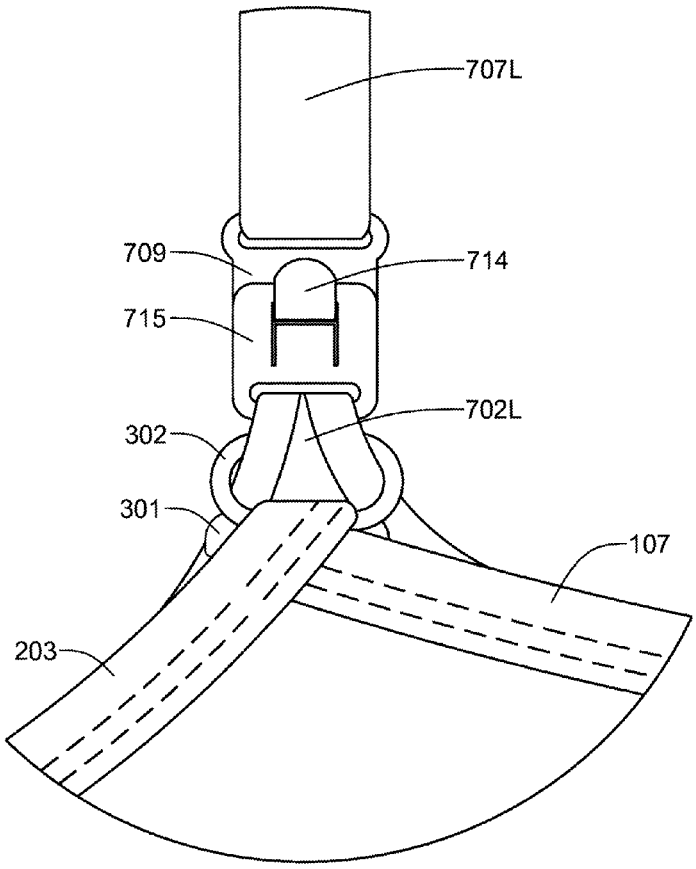
FIG. 10 is an enlarged view of circular region 10 of FIG. 7, but with the undergarment attached to the fold-down cup cover flap with the silicon rubber O-ring, rather than with the strap attachment clip.

Referring now to FIG. 10, a close-up view is shown of the right peak 104R attached to fold-down cup cover flap 702R with the silicon rubber O-ring 301. The associated strap attachment clip 302 has been folded behind the peak 104R of the undergarment 100.

Figure 11:
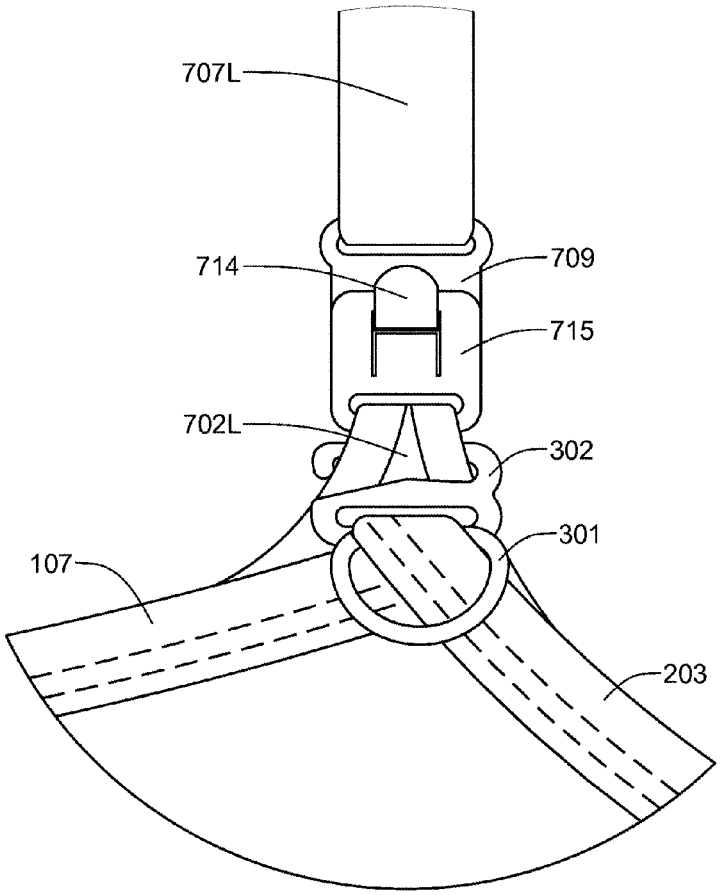
FIG. 11 is an enlarged view of circular region 11 of FIG. 7, but with the undergarment attached to the fold-down cup cover flap with the strap attachment clip, rather than with the silicon rubber O-ring.

Referring now to FIG. 11, a close-up view is shown of the left peak 104L attached to fold-down cup cover flap 702L with a strap attachment clip 302. The associated O-ring 301 remains unused and has been folded down on the front of the peak 104L of the undergarment 100.

It should be understood that the rear upper edge 202 of the undergarment 100 is positioned just below the level of the wearer's armpits, and retain retains its vertical position on the torso because the garment 100 is fitted to the woman's body, and because the rear upper edge 202 is coupled to the arcuate half-troughs 106R and 106L, which are secured at the peaks 104R and 104L, respectively, to the woman's brassiere, which in turn is help up by the right and left over-the shoulder straps 707R and 707L, respectively. A woman dresses herself by strapping on her nursing brassiere 701, then pulling the undergarment 100 over her head and over the nursing bra 701. Each peak 104R and 104L of the undergarment 100 is then secured to an uppermost portion of each fold-down cup cover flap 702R and 702L of the nursing bra 701 using either the attached rubber O-ring 301 or the strap attachment clip 502.

Though only a single embodiment of an undergarment that attaches to a top-opening nursing brassiere have been heretofore disclosed and described, it will be obvious to those having ordinary skill in the art that changes and modifications may be made thereto without departing from the scope and the spirit of the invention as hereinafter claimed.

What is claimed is:

1. In combination with a nursing brassiere having shoulder straps and an at least partially detachable fold-down cover for each of two cups, an undergarment comprising:

a strapless, sleeveless, shoulder-baring, pull-over garment body formed from front and rear stretch knit fabric panels that are joined at generally vertical side seams, said garment body having a bottom hem and front and rear upper edges, said garment body configured to be worn with said vertical side seams beneath a wearer's armpits; and at least one pair of spaced-apart attachment devices non-releasably secured to the front upper edge of said garment body, said attachment devices enabling said upper edge of said garment body to be releasably secured to an uppermost portion of each fold-down cover flap of said nursing brassiere, wherein, the garment body is selectively convertible in combination with said fold-down cover flaps of said nursing brassiere between (i) a first configuration having one or both of the cover flaps folded down to at least partially expose a portion of said nursing brassiere, and (ii) a second configuration having both of the cover flaps folded up to substantially conceal said nursing brassiere, and each one of said pair of spaced-apart attachment devices includes a plurality of attachment devices that are (i) commonly secured to a peak at a single distal point along the upper edge of the garment body, (ii) operable to be alternately secured to the front upper edge of said garment body, and (iii) operable to pivot away from each other.

2. The combination of claim 1, wherein said at least one pair of spaced-apart attachment devices includes one pair of metal hooks.

3. The combination of claim 1, wherein said at least one pair of spaced-apart attachment devices includes one pair of silicone rubber O-rings.

4. The combination of claim 1, wherein said front and rear panels are warp knitted from spandex fibers combined with at least one other type of fiber selected from the group consisting of cotton, modal, linen, flax, jute, hemp, wool, silk, polyester, nylon and acrylic fibers.

5. The combination of claim 1, wherein said front panel includes the front upper edge with a bilaterally-symmetrical wave pattern, said wave pattern having two spaced-apart peaks, a central trough which joins the peaks, and an arcuate half-trough on an outer side of each peak, each arcuate half-trough transitioning to a rear upper edge of the undergarment.

6. The combination of claim 5, wherein said front upper edge and said rear upper edge are hemmed by wrapping them with bias binding ribbon made of a same type of fabric from which the front and rear panels are made.

7. The combination of claim 6, wherein a first length of bias binding ribbon is used to hem the edge of the central trough, and a second length of bias binding ribbon is used to hem not only the rear upper edge of the undergarment, but also the edges of arcuate half-troughs, as well, said second length of bias binding ribbon providing reinforcement to the top of each vertical side seam.

8. The combination of claim 1, wherein said plurality of attachment devices includes one pair of metal hooks and one pair of silicone rubber O-rings.

9. A nursing undergarment combination comprising:

a nursing brassiere equipped with shoulder straps, at least one partially open cup, and at least one partially detachable fold-down cup cover flap;

a strapless, sleeveless, shoulder-baring, pull-over garment body formed from stretch knit fabric, said garment body having a bottom hem and front and rear upper edges; and at least one pair of spaced-apart attachment devices non-releasably secured to the front upper edge of said garment body, said attachment devices enabling said upper edge of said garment body to be releasably secured to an uppermost portion of one of a pair of at least partially detachable fold-down cup cover flaps of the nursing brassiere equipped with shoulder straps, wherein, the garment body is selectively convertible in combination with each one of said fold-down cup cover flaps of said nursing brassiere between (i) a first configuration having one or both of said fold-down cup cover flaps folded down to at least partially expose a portion of said nursing brassiere, and (ii) a second configuration having both of said fold-down cup cover flaps folded up to substantially conceal said nursing brassiere, and each one of said pair of spaced-apart attachment devices includes a plurality of attachment devices that are (i) commonly secured to a peak at a single distal point along the upper edge of the garment body, (ii) operable to be alternately secured to the front upper edge of said garment body,and(iii)operable to pivot away from each other.

10. The nursing undergarment combination of claim 9, wherein said at least one pair of spaced-apart attachment devices includes one pair of metal hooks.

11. The nursing undergarment combination of claim 9, wherein said at least one pair of spaced-apart attachment devices includes one pair of silicone rubber O-rings.

12. The nursing undergarment combination of claim 9, wherein said fabric is warp knitted from spandex fibers combined with at least one other type of fiber selected from the group consisting of cotton, modal, linen, flax, jute, hemp, wool, silk, polyester, nylon and acrylic fibers.

13. The nursing undergarment combination of claim 9, wherein said garment body has a front panel with the front upper edge having a bilaterally-symmetrical wave pattern, said wave pattern having two spaced-apart peaks, a central trough which joins the peaks, and an arcuate half-trough on an outer side of each peak, each arcuate half-trough transitioning to a rear upper edge of the undergarment.

14. The nursing undergarment combination of claim 13, wherein said front upper edge and said rear upper edge are hemmed by wrapping them with bias binding ribbon made of a same type of fabric as the garment body, and wherein a first length of bias binding ribbon is used to hem the edge of the central trough, and a second length of bias binding ribbon is used to hem not only the rear upper edge of the undergarment, but also the edges of arcuate half-troughs, as well.

15. The nursing undergarment combination of claim 9, wherein each one of said pair of spaced-apart attachment devices includes a plurality of attachment devices.

16. The nursing undergarment combination of claim 15, wherein said plurality of attachment devices includes one pair of metal hooks and one pair of silicone rubber O-rings.

17. The nursing undergarment combination of claim 9, wherein each one of said pair of spaced-apart attachment devices includes a plurality of different attachment devices.

* * * * *